US010112684B1

(12) United States Patent
Bahena et al.

(10) Patent No.: US 10,112,684 B1
(45) Date of Patent: Oct. 30, 2018

(54) SELF SUPPORTING CANOPY

(71) Applicant: GOODRICH CORPORATION, Charlotte, NC (US)

(72) Inventors: Daniel Bahena, Phoenix, AZ (US); Timothy C. Haynes, Prescott Valley, AZ (US)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 15/684,041

(22) Filed: Aug. 23, 2017

(51) Int. Cl.

| | |
|---|---|
| ***B63B 17/02*** | (2006.01) |
| ***B63C 9/02*** | (2006.01) |
| ***B63C 9/04*** | (2006.01) |
| ***B63B 7/08*** | (2006.01) |
| ***E04H 15/20*** | (2006.01) |

(52) U.S. Cl.
CPC ..... *B63B 17/02* (2013.01); *B63B 7/085* (2013.01); *B63C 9/02* (2013.01); *B63C 9/04* (2013.01); *E04H 15/20* (2013.01); *B63C 2009/044* (2013.01)

(58) Field of Classification Search
CPC ..... B63B 43/00; B63B 43/12; B63C 9/00; B63C 9/02; B63C 9/04; B63C 9/03
USPC ..... 441/38, 40
See application file for complete search history.

(56) References Cited

U.S. PATENT DOCUMENTS

| | | | | |
|---|---|---|---|---|
| 3,034,154 | A * | 5/1962 | Silverstone | B63C 9/02 441/38 |
| 3,092,854 | A * | 6/1963 | Manhart | B63C 9/02 441/38 |
| 4,180,882 | A * | 1/1980 | Kawasaki | B63C 9/04 440/38 |
| 4,790,784 | A * | 12/1988 | Givens | B63C 9/04 441/40 |
| 5,921,831 | A * | 7/1999 | Schulze | B63B 43/12 441/38 |
| 6,192,633 | B1 * | 2/2001 | Hilbert | E04H 1/1277 52/2.18 |
| 6,623,322 | B1 * | 9/2003 | Lesniak | B63B 7/085 441/38 |
| 6,685,520 | B1 * | 2/2004 | Wiggins | B63B 43/12 441/40 |

FOREIGN PATENT DOCUMENTS

| | | |
|---|---|---|
| GB | 835061 | 5/1960 |

* cited by examiner

*Primary Examiner* — Lars A Olson
(74) *Attorney, Agent, or Firm* — Snell & Wilmer L.L.P.

(57) ABSTRACT

An inflatable canopy assembly includes an inflatable canopy cover, and a tunnel structural system integrated into the inflatable canopy cover. The tunnel structural system is positioned to provide a frame structure to the inflatable canopy assembly.

20 Claims, 4 Drawing Sheets

SELF SUPPORTING CANOPY

FIELD

The present disclosure relates generally to slide rafts and more specifically to inflatable canopy assemblies for slide rafts.

BACKGROUND

Inflatable slide raft evacuation systems for aircrafts generally have a canopy and corresponding stubs that inflate with the slide raft evacuation system and protrude during deployment, evacuation, and when the canopy is not being utilized. The canopy stubs are generally integrated with the slide raft and inflate with the slide raft. The current canopy stub designs may add manufacturing cost and excess fabric to the system. Other inflatable slide raft evacuation systems have removed the canopy stubs and replaced them with canopy support metal tubes that can be installed on the side of the slide to utilize accordingly. The use of a metal tube design adds the weight of the metal tubes and additional pack density to the evacuation system, thereby increasing the cost of the slide raft evacuation system.

SUMMARY

In various embodiments, an inflatable canopy assembly, includes an inflatable canopy cover, and a tunnel structural system integrated into the inflatable canopy cover, wherein the tunnel structural system is positioned to provide a frame structure to the inflatable canopy assembly.

In various embodiments of the inflatable canopy assembly, the frame structure is formed in response to said tunnel structural system being inflated.

In various embodiments, the inflatable canopy assembly further includes an inflation fitting coupled to the tunnel structural system.

In various embodiments of the inflatable canopy assembly, the inflation fitting is in fluid communication with an inflation valve.

In various embodiments of the inflatable canopy assembly, an inflation fitting is located at a corner of the tunnel structural system.

In various embodiments of the inflatable canopy assembly, the inflation fitting is capable of receiving air manually.

In various embodiments of the inflatable canopy assembly, the tunnel structural system forms a triangular shape.

In various embodiments of the inflatable canopy assembly, the tunnel structural system is made of at least one of a polyester or PTFE fabric.

In various embodiments of the inflatable canopy assembly, a first structural tunnel and a second structural tunnel coalesce at an upper base tunnel to form the frame structure.

In various embodiments of the inflatable canopy assembly, a third structural tunnel and fourth structural tunnel coalesce at an upper base tunnel to form the frame structure.

In various embodiments of the inflatable canopy assembly, the first structural tunnel and the second structural tunnel are in parallel with the third structural tunnel and the fourth structural tunnel.

In various embodiments of the inflatable canopy assembly, the tunnel structural system forms an elongated dome like structure.

In various embodiments, an evacuation system includes a raft, an inflation valve coupled to the raft, and an inflatable canopy assembly capable of being in fluid communication with the inflation valve, wherein the inflatable canopy assembly has a tunnel structural system integrated into an inflatable canopy cover to provide structural support for the inflatable canopy assembly.

In various embodiments, the evacuation system includes an inflation fitting coupled to the tunnel structural system.

In various embodiments of the evacuation system, the structural support is a frame structure.

In various embodiments of the evacuation system, a first structural tunnel, a second structural tunnel, a third structural tunnel, and a fourth structural tunnel coalesce at an upper base tunnel to form the frame structure.

In various embodiments of the evacuation system, the tunnel structural system forms an elongated dome like structure.

In various embodiments of the evacuation system, the inflated canopy assembly is tied down to the raft with a nylon cord.

In various embodiments, a method of erecting an inflatable canopy assembly, the method includes deploying the inflatable canopy assembly, inflating the inflatable canopy assembly, and erecting the inflatable canopy assembly using a tunnel structural system integrated into an inflatable canopy cover of the inflatable canopy assembly to provide structural support for the inflatable canopy assembly.

In various embodiments of the method, the inflatable canopy assembly is inflated using an inflation fitting coupled to the tunnel structural system.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein. Thus, the detailed description herein is presented for purposes of illustration only and not of limitation. The scope of the disclosure is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step.

Figure 1:
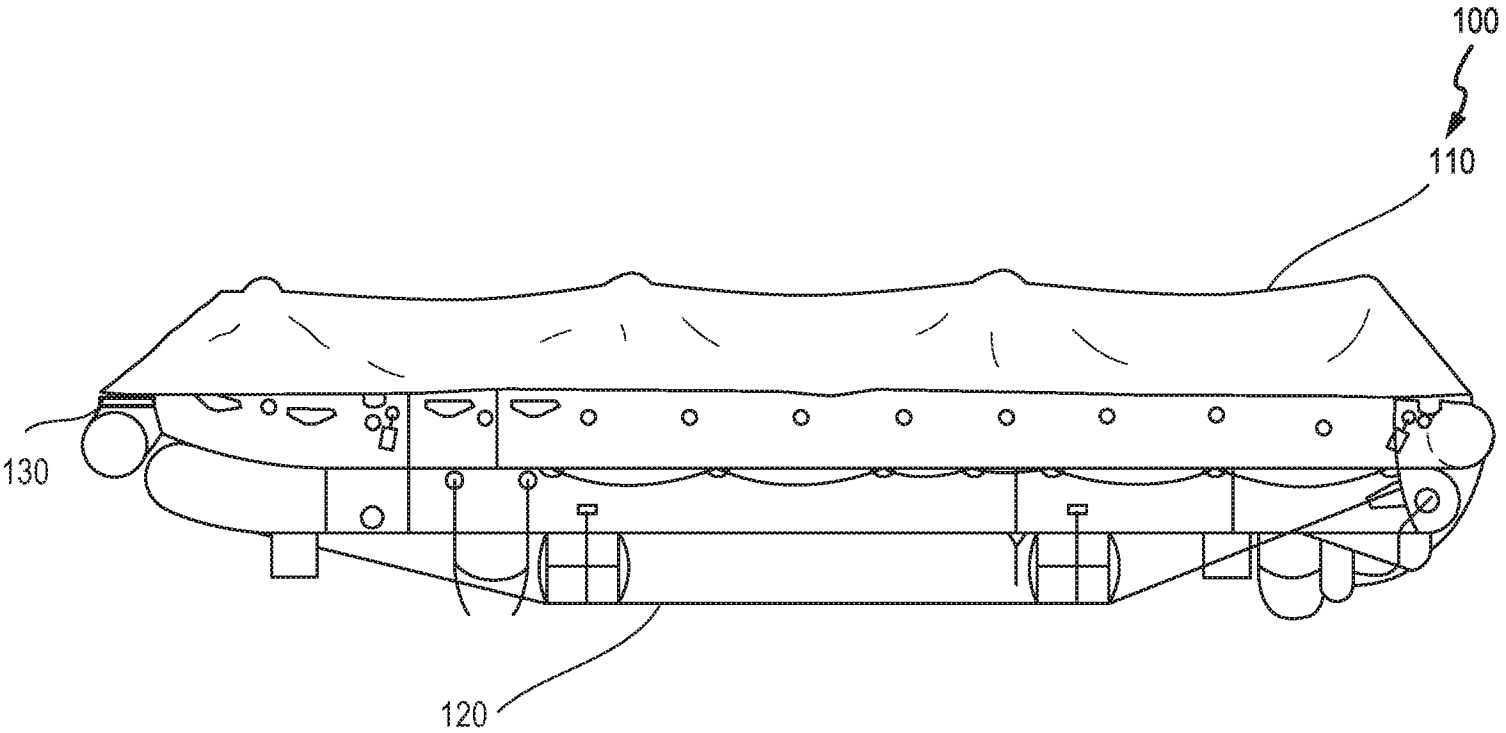
FIG. 1 illustrates, in accordance with various embodiments, a front view of an evacuation system.

With reference to FIG. 1, an evacuation system 100 is illustrated, in accordance with various embodiments. Evacuation system 100 includes a slide raft 120, and an inflatable canopy assembly 110, and an inflation valve 130. Inflation valve 130 may be in fluid communication with inflation fitting 260 (with momentary reference to FIG. 2) of inflatable canopy assembly 110. Inflation valve 130 may be coupled to a compressed gas cylinder and an aspirator, where the aspirator entrains ambient air for use by slide raft 120 and/or inflatable canopy assembly 110. In various embodiments, slide raft 120 may be, for example, an inflatable slide used for passengers to exit the aircraft. In various embodiments, slide raft 120 may be, for example, any type of life raft capable of utilizing inflatable canopy assembly 110. For example, slide raft 120 may be a life raft used for a helicopter. Inflatable canopy assembly 110 may be coupled to slide raft 120 by, for example, being sewn onto slide raft 120, utilizing an adhesive to connect canopy assembly 110 to slide raft 120, using hooks or rings to connect canopy assembly 110 to slide raft 120, or utilizing any other method of otherwise affixing canopy assembly 110 to slide raft 120. For example, inflatable canopy assembly 110 may be coupled to slide raft 120 using a nylon cord and/or Velcro.

During an aircraft emergency where evacuation system 100 may be used, evacuation system 100 may be deployed from a packed position from a patch board located on, for example, the door of the aircraft. The door of the aircraft may be opened by, for example, the flight crew and connected by a bar that holds the evacuation system 100 in place. In various embodiments, in response to the door of the aircraft opening, the bar pulls the evacuation system 100 out the pack board and deploys the slide raft 120 and inflatable canopy assembly 110. Slide raft 120, which may also function as a slide to exit an aircraft, may be coupled to the bottom of the aircraft and, in response to deployment, allow for passengers to exit the aircraft.

Figure 2:
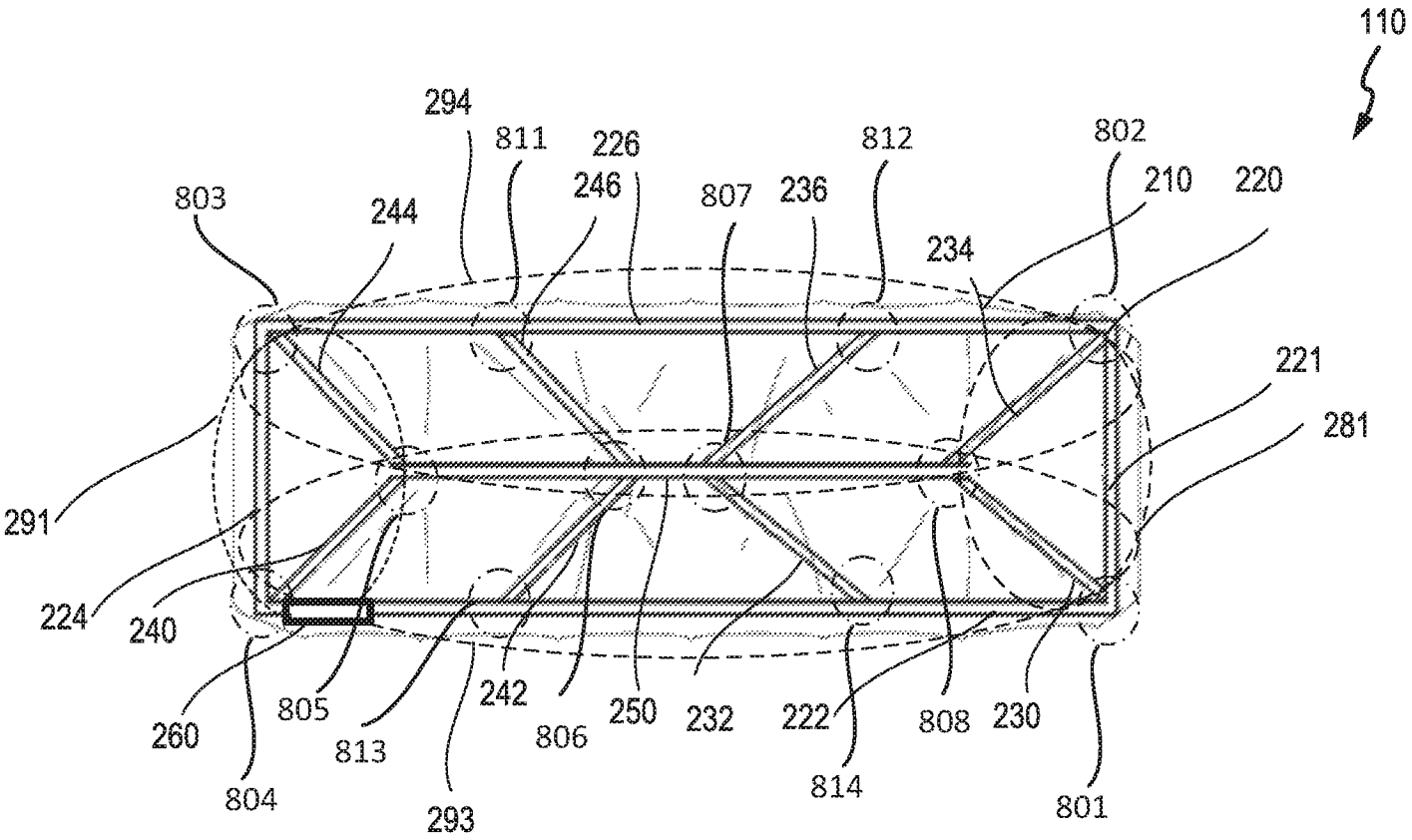
FIG. 2 illustrates, in accordance with various embodiments, a top view of an inflatable canopy assembly.

In various embodiments, during deployment of evacuation system 100, slide raft 120 and inflatable canopy assembly 110 may be inflated to yield the deployed evacuation system 100 shown in FIG. 1. A tunnel structural system 220 with an inflation fitting 260 (with momentary reference to FIG. 2) is integrated within inflatable canopy assembly 110. Utilizing inflation fitting 260, tunnel structural system 220 inflates to provide the structure needed to rise over slide raft 120 and provide shade during operation of slide raft 120. As can be seen in FIG. 2, tunnel structural system 220 is interconnected to retain air provided by, for example, a manual air pump supplied with a slide raft kit provided with slide raft 120 or inflation valve 130. In various embodiments, the tunnel structural system 220 is designed to be inflated in order to provide an elongated dome like structure similar to the structure shown in FIG. 1.

With reference to FIG. 2, inflatable canopy assembly 110 is illustrated in accordance with various embodiments. Inflatable canopy assembly 110 includes an inflatable canopy cover 210, tunnel structural system 220, and an inflation fitting 260. In various embodiments, inflation valve 130 provides air to slide raft 120 and/or inflation fitting 260 of tunnel structural system 220. In various embodiments, air may be provided to inflation fitting 260 using a manual pump utilized by, for example, passengers of slide raft 120. In various embodiments, air is provided to tunnel structural system 220 until tunnel structural system 220 of inflatable canopy assembly 110 is fully inflated.

Tunnel structural system 220 provides the structure for inflatable canopy assembly 110 and in this embodiment includes a first base tunnel 221, a second second base tunnel 222, a third base tunnel 224, a fourth base tunnel 226, a first structural tunnel 230, a second structural tunnel 232, a third structural tunnel 234, a fourth structural tunnel 236, a fifth structural tunnel 240, a sixth structural tunnel 242, a seventh structural tunnel 244, an eighth structural tunnel 246, and an upper base tunnel 250. In various embodiments, tunnel structural system 220 and inflatable canopy assembly 110 may be made from nylon, ballistic nylon, polypropylene, polyester, cotton, polytetrafluoroethylene (PTFE) or any other suitable material, whether coated or uncoated. In various embodiments, tunnel structural system 220 and inflatable canopy assembly 110 may be made of a nylon based textile having a coating, the coating comprising a polymeric material such as polyurethane, neoprene, or the like.

In various embodiments, first base tunnel 221 is coupled to and in fluid communication with second base tunnel 222 and first structural tunnel 230 at a first joint 801. First base tunnel 221 is coupled to and in fluid communication with fourth base tunnel 226 and third structural tunnel 234 at a second joint 802. Third base tunnel 224 is coupled to and in fluid communication with fourth base tunnel 226 and seventh structural tunnel 244 at a third joint 803. Third base tunnel 224 is coupled to and in fluid communication with second base tunnel 222 and fifth structural tunnel 240 at a fourth joint 804. Fourth base tunnel 226 may be coupled to and in fluid communication with eighth structural tunnel 246 at a ninth joint 811. Fourth base tunnel 226 may be coupled to and in fluid communication with fourth structural tunnel 236 at a tenth joint 812. Second base tunnel 222 may be coupled to and in fluid communication with sixth structural tunnel 242 at an eleventh joint 813. Second base tunnel 222 may be coupled to and in fluid communication with second structural tunnel 232 at a twelfth joint 814.

Upper base tunnel 250 may be coupled to and in fluid communication with seventh structural tunnel 244 and fifth structural tunnel 240 at a fifth joint 805. Upper base tunnel 250 may be coupled to and in fluid communication with sixth structural tunnel 242 and eighth structural tunnel 246 at a sixth joint 806. Upper base tunnel 250 may be coupled to and in fluid communication with fourth structural tunnel 236 and second structural tunnel 232 at a seventh joint 807. Upper base tunnel 250 may be coupled to and in fluid communication with third structural tunnel 234 and first structural tunnel 230 at an eighth joint 808.

In various embodiments, third structural tunnel 234 and first structural tunnel 230 coalesce at upper base tunnel 250 and form a triangular shape whose apex is at upper base tunnel 250. Fourth structural tunnel 236 and second structural tunnel 232 coalesce at upper base tunnel 250 and form a triangular shape whose apex is at upper base tunnel 250. Seventh structural tunnel 244 and fifth structural tunnel 240 coalesce at upper base tunnel 250 and form a triangular shape whose apex is at upper base tunnel 250. Eighth structural tunnel 246 and sixth structural tunnel 242 coalesce at upper base tunnel 250 and form a triangular shape whose apex is at upper base tunnel 250. In various embodiments, first structural tunnel 230 and third structural tunnel 234, second structural tunnel 232 and fourth structural tunnel 236, sixth structural tunnel 242 and eighth structural tunnel 246, seventh structural tunnel 244 and fifth structural tunnel 240, may coalesce at upper base tunnel 250 to form other shapes, such as, for example a parabola.

In various embodiments, third structural tunnel 234 and first structural tunnel 230 coalesce at upper base tunnel 250 to serve as a structure for a first side wall 281 (the circled portion of inflatable canopy cover 210 shown in FIG. 2) of inflatable canopy assembly 110. Seventh structural tunnel 244 and fifth structural tunnel 240 coalesce at upper base tunnel 250 to serve as a structure for a second side wall 291 (the circled portion of inflatable canopy cover 210 shown in FIG. 2) of inflatable canopy assembly 110. In various embodiments, first base tunnel 221, second base tunnel 222, third base tunnel 224, and fourth base tunnel 226 are coupled together to form the lower base of inflatable canopy assembly 110. Upper base tunnel 250 serves as the upper base of inflatable canopy assembly 110 to support, for example, structural tunnels 234, 230, 236, 232, 246, 242, 244, and 240. Structural tunnels 234, 230, 236, 232, 246, 242, 244, and 240 combine with first base tunnel 221, upper base tunnel 250, and inflatable canopy cover 210 to form the walls of the inflatable canopy assembly 110. For example, third structural tunnel 234, first structural tunnel 230, first base tunnel 221, upper base tunnel 250, and inflatable canopy cover 210 combine to form side wall 281 (the circled portion of inflatable canopy cover 210 shown in FIG. 2). Seventh structural tunnel 244, fifth structural tunnel 240, first base tunnel 221, upper base tunnel 250, and inflatable canopy cover 210 combine to form side wall 291 (the circled portion of inflatable canopy cover 210 shown in FIG. 2). In various embodiments, first structural tunnel 230, second structural tunnel 232, sixth structural tunnel 242, fifth structural tunnel 240, upper base tunnel 250, and second base tunnel 222 combine to form sidewall 293. Third structural tunnel 234, fourth structural tunnel 236, eighth structural tunnel 246, seventh structural tunnel 244, upper base tunnel 250, and fourth base tunnel 226 combine to form sidewall 294.

In various embodiments, during operation of inflatable canopy assembly 110, inflatable canopy assembly 110 is inflated using an inflation valve 130 supplied with slide raft 120 which may be in fluid communication with inflation fitting 260 of inflatable canopy assembly 110. During inflation of inflatable canopy assembly 110, tunnel structural system 220 is inflated via inflation fitting 260 to provide structural support to inflatable canopy assembly 110. That is, tunnel structural system 220 is positioned to provide a frame structure to the inflation canopy cover 210 of inflatable canopy assembly 110. When tunnel structural system 220 is inflated, tunnel structural system 220, sidewall 281, sidewall 291, sidewall 293, and sidewall 294 in combination with inflatable canopy cover 210 form inflatable canopy assembly 110. In various embodiments, the shape of inflatable canopy assembly 110 matches the shape of tunnel structural system 220. In various embodiments, after inflation of tunnel structural system 220, inflatable canopy cover 210, in combination with tunnel structural system 220, combine to form side walls 281, 291, 293, and 294, as well as cover for inflatable canopy assembly 110 over slide raft 120 to provide shelter to passengers of slide raft 120.

Figure 3:
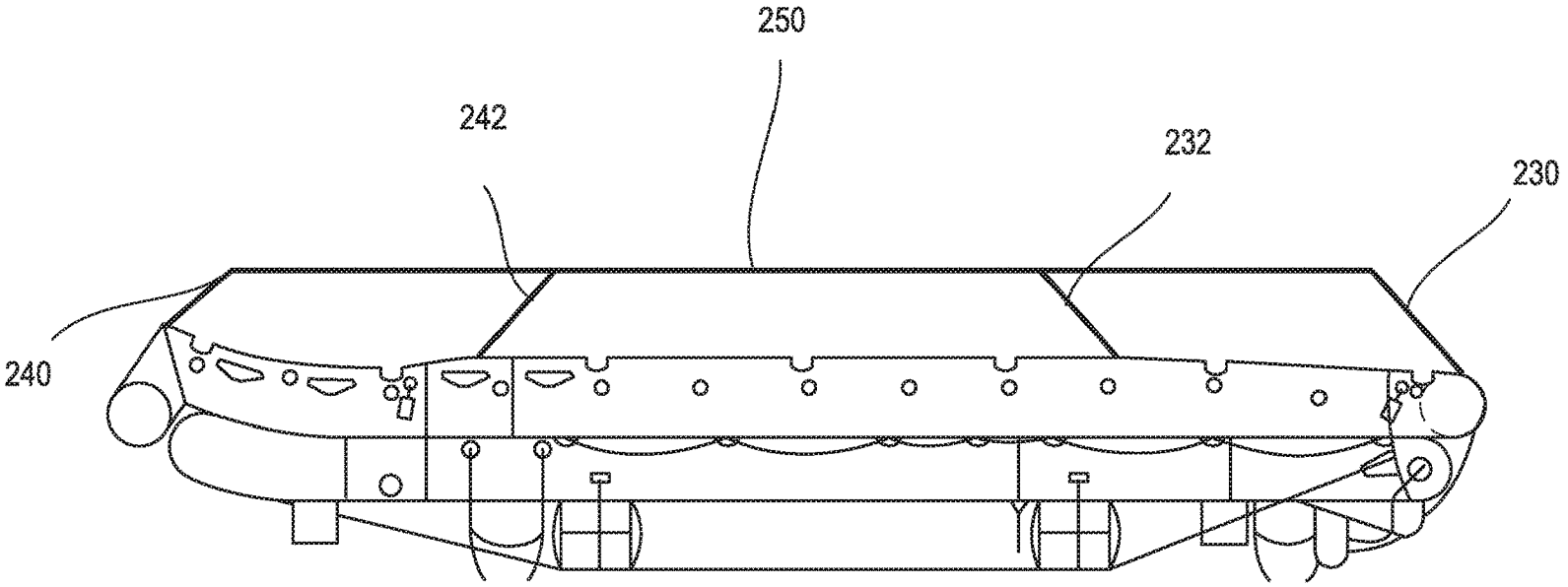
FIG. 3 illustrates, in accordance with various embodiments, a side view of an inflatable canopy assembly with a tunnel structural system.

With reference to FIG. 3, inflatable canopy assembly 110 is depicted with tunnel structural system 220 further illustrated using a side view. FIG. 3 shows tunnel structural system 220 providing the structure for inflatable canopy assembly 110. Upper base tunnel 250 is shown in fluid communication with fifth structural tunnel 240, sixth structural tunnel 242, second structural tunnel 232, and first structural tunnel 230. Tunnel structural system 220 has been inflated and is positioned to allow inflatable canopy cover 210 to provide shade for slide raft 120.

Figure 4:
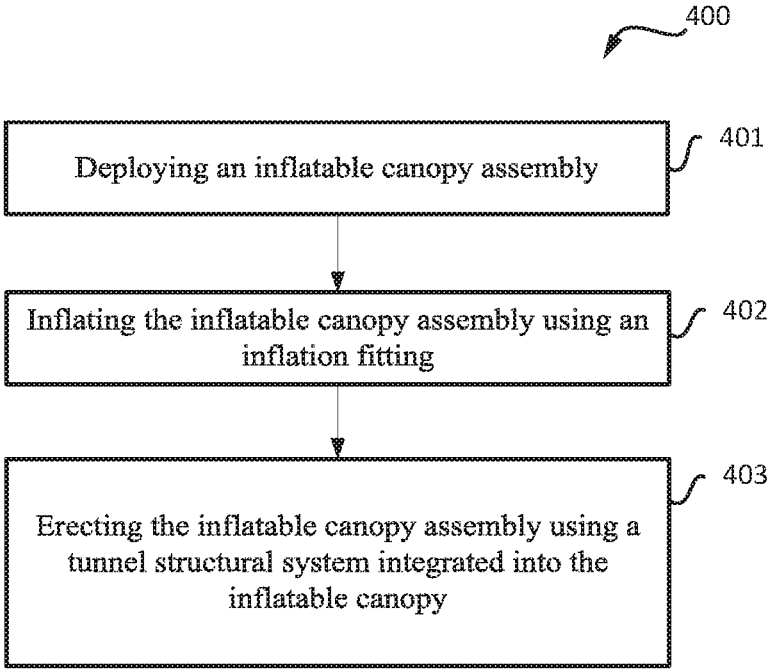
FIG. 4 illustrates a method of erecting an inflatable canopy assembly is illustrated according to various embodiments.

With reference to FIG. 4, a method of erecting a canopy assembly is illustrated according to various embodiments. In Step 401, an inflatable canopy assembly 110 is deployed. In Step 402, inflatable canopy assembly 110 is inflated using inflation fitting 260. In Step 403, inflatable canopy assembly 110 is erected using a tunnel structural system 220 integrated into inflatable canopy assembly 110.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. An inflatable canopy assembly, comprising: an inflatable canopy cover; and a tunnel structural system integrated into said inflatable canopy cover, wherein said tunnel structural system provides a frame structure to said inflatable canopy assembly and comprises base tunnels extending along a perimeter of a raft, structural tunnels extending from said base tunnels, and an upper base tunnel providing a height support for said inflatable canopy cover, said structural tunnels intermediate said base tunnels and said upper base tunnel.

2. The inflatable canopy assembly of claim 1, wherein said frame structure is formed in response to said tunnel structural system being inflated.

3. The inflatable canopy assembly of claim 1, further comprising an inflation fitting coupled to said tunnel structural system.

4. The inflatable canopy assembly of claim 3, wherein said inflation fitting is in fluid communication with an inflation valve.

5. The inflatable canopy assembly of claim 1, wherein an inflation fitting is located at a corner of said tunnel structural system.

6. The inflatable canopy assembly of claim 3, wherein said inflation fitting is capable of receiving air manually.

7. The inflatable canopy assembly of claim 1, wherein said tunnel structural system forms a triangular shape.

8. The inflatable canopy assembly of claim 1, wherein said tunnel structural system is made of at least one of a polyester or PTFE fabric.

9. The inflatable canopy assembly of claim 1, wherein the structural tunnels include a first structural tunnel and a second structural tunnel that coalesce at the upper base tunnel to form at least a part of said frame structure.

10. The inflatable canopy assembly of claim 9, wherein the structural tunnels include a third structural tunnel and a fourth structural tunnel that coalesce at the upper base tunnel to form at least a part of said frame structure.

11. The inflatable canopy assembly of claim 10, wherein said first structural tunnel and said second structural tunnel are in parallel with said third structural tunnel and said fourth structural tunnel.

12. The inflatable canopy assembly of claim 10, wherein said tunnel structural system forms an elongated dome structure.

13. An evacuation system, comprising: a raft; an inflation valve coupled to said raft; and an inflatable canopy assembly in fluid communication with said inflation valve, wherein said inflatable canopy assembly has a tunnel structural system integrated into an inflatable canopy cover to provide structural support for said inflatable canopy assembly; wherein said tunnel structural system comprises base tunnels extending along a perimeter of the raft, structural tunnels extending from said base tunnels, and an upper base tunnel providing a height support from said inflatable canopy assembly, said structural tunnels intermediate said base tunnels and said upper base tunnel.

14. The evacuation system of claim 13, further comprising an inflation fitting coupled to said tunnel structural system.

15. The evacuation system of claim 13, wherein said structural support is a frame structure.

16. The evacuation system of claim 15, wherein the structural tunnels include a first structural tunnel, a second structural tunnel, a third structural tunnel, and a fourth structural tunnel that coalesce at the upper base tunnel to form at least a part of said frame structure.

17. The evacuation system of claim 13, wherein said tunnel structural system forms an elongated dome structure.

18. The evacuation system of claim 13, wherein said inflatable canopy assembly extends about the perimeter of said raft.

19. A method of erecting an inflatable canopy assembly, comprising: deploying said inflatable canopy assembly; inflating said inflatable canopy assembly; and erecting said inflatable canopy assembly using a tunnel structural system integrated into an inflatable canopy cover of said inflatable canopy assembly to provide structural support for said inflatable canopy assembly; wherein said tunnel structural system comprises base tunnels extending along a perimeter of a raft, structural tunnels extending from said base tunnels, and an upper base tunnel providing a height support for said inflatable canopy assembly, said structural tunnels intermediate said base tunnels and said upper base tunnel.

20. The method of claim 19, wherein said inflatable canopy assembly is inflated using an inflation fitting coupled to said tunnel structural system.

* * * * *